US009555618B2

(12) United States Patent
Delang et al.

(10) Patent No.: US 9,555,618 B2
(45) Date of Patent: Jan. 31, 2017

(54) METHOD FOR THE AUTOMATED DEFINITION OF COLOR TEST VALUES

(71) Applicant: HEIDELBERGER DRUCKMASCHINEN AG, Heidelberg (DE)

(72) Inventors: Ulf Delang, Walldorf (DE); Harald Bucher, Eschelbronn (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 81 days.

(21) Appl. No.: 14/339,486

(22) Filed: Jul. 24, 2014

(65) Prior Publication Data

US 2015/0027330 A1 Jan. 29, 2015

(30) Foreign Application Priority Data

Jul. 24, 2013 (DE) ..... 10 2013 012 299

(51) Int. Cl.

| | |
|---|---|
| ***B41F 1/18*** | (2006.01) |
| ***B41F 31/00*** | (2006.01) |
| ***B41F 31/02*** | (2006.01) |
| ***B41F 31/04*** | (2006.01) |
| ***B41F 33/00*** | (2006.01) |

(52) U.S. Cl.

CPC ..... *B41F 31/00* (2013.01); *B41F 31/02* (2013.01); *B41F 31/04* (2013.01); *B41F 33/0027* (2013.01)

(58) Field of Classification Search

CPC ..... B41F 33/0027; B41F 33/0045; B41F 33/0054;B41M 1/06; B41M 1/00; G03G 2215/00776; G03G 15/2039

See application file for complete search history.

(56) References Cited

U.S. PATENT DOCUMENTS

| | | | | |
|---|---|---|---|---|
| 2005/0018219 | A1 | 1/2005 | Senn et al. | |
| 2008/0127846 | A1* | 6/2008 | Nagai | 101/365 |
| 2009/0244125 | A1* | 10/2009 | Ozaki et al. | 347/9 |

FOREIGN PATENT DOCUMENTS

| | | | |
|---|---|---|---|
| DE | 102007008640 | A1 | 9/2007 |
| EP | 1501280 | A1 | 1/2005 |

* cited by examiner

*Primary Examiner* — Matthew G Marini

(74) *Attorney, Agent, or Firm* — Laurence A. Greenberg; Werner H. Stemer; Ralph E. Locher

(57) ABSTRACT

A method sets the inking in a printing press with multiple ink zones in an inking unit of a printing unit. The method includes: printing a test form onto a printing substrate with an intentional pre-defined color deviation from the intended target color; correcting the previously set ink setting and the defined set color deviation with regard to the respective target value in the wet condition of the printing substrate by a color measuring device; and taking color measurements of the dried printing substrate using the color measuring device. The measured color values established in the dry state and the original of the test form in a computer are compared. The ink setting that belongs to the ink zone with the smallest deviation from the intended target color is used as the target ink setting for the printing process.

11 Claims, 1 Drawing Sheet

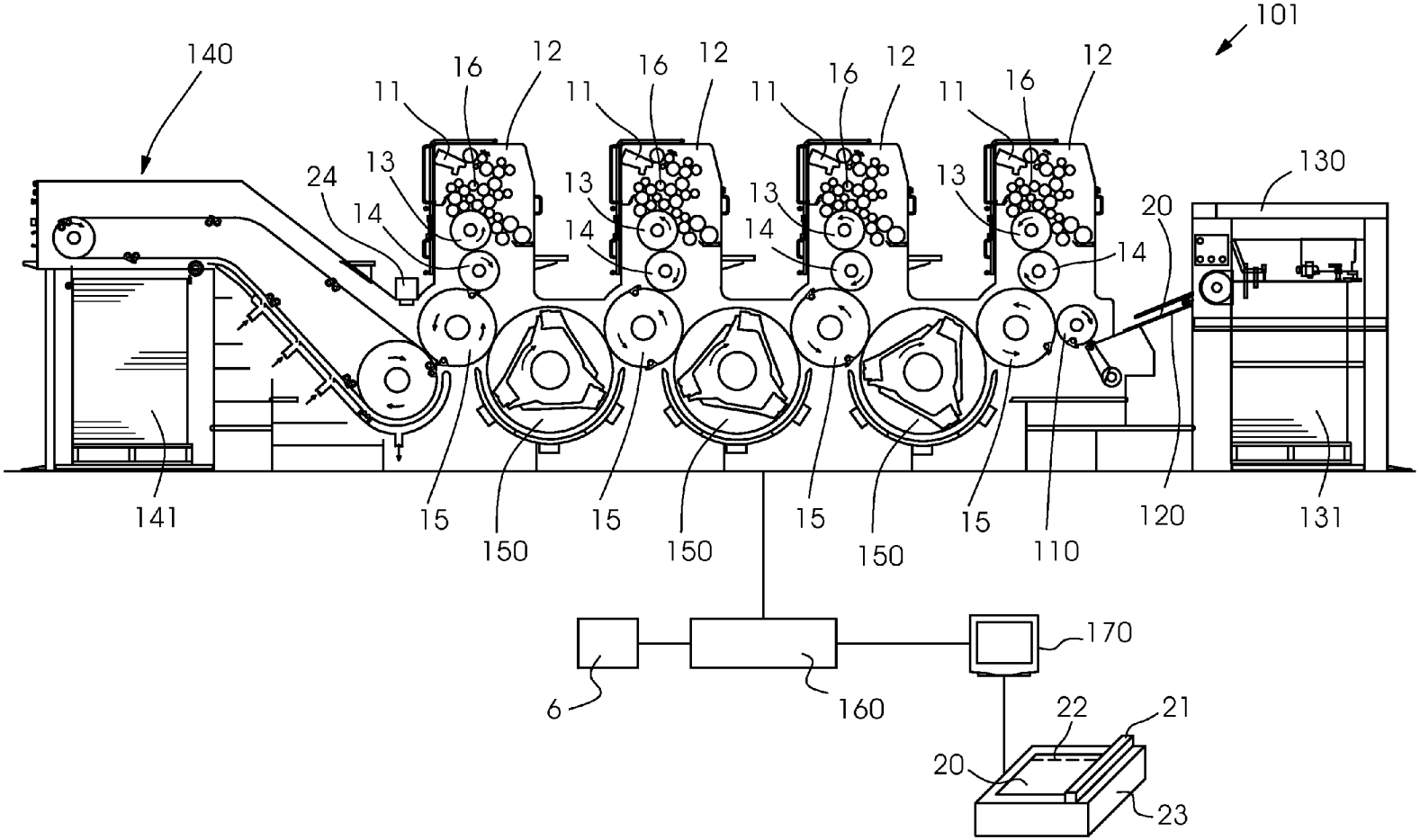
101
130
131
20
120
110
14
12
16
11
13
15
150
170
21
23
22
160
6
24
140
141

METHOD FOR THE AUTOMATED DEFINITION OF COLOR TEST VALUES

CROSS-REFERENCE TO RELATED APPLICATION

This application claims the priority, under 35 U.S.C. §119, of German application DE 10 2013 012 299.6, filed Jul. 24, 2013; the prior application is herewith incorporated by reference in its entirety.

BACKGROUND OF THE INVENTION

Field of the Invention

The present invention relates to a method for adjusting the ink settings in multiple steps in a printing press with multiple ink zones in an inking unit of a printing unit.

In the production of print shop products, a major aspect is to reproduce the colors of the original, also referred to as the template, with as much fidelity as possible. This task is independent of the printing process that will be applied. However, in particular when rotary lithographic offset printing presses are used, quality demands are high especially in terms of color reproduction. Print shops need to meet these high quality requirements, some of them acquiring certificates in accordance with printing industry standards. In particular in lithographic offset printing, the acquisition of certificates is a complex process due to a number of technical aspects. In current certification processes, the first step is to use printing plates of a test form to print with different inking levels in the press. On the next day or after several hours of drying, measurements are taken on the resultant printing substrates. In the first place, this involves a considerable loss of time. This step is repeated until the original of the test form and the measured color values are within a defined tolerance. Subsequently, the quality of the print is examined using a color measuring device to obtain information on dot gain, contrast, gray value balance, slurring and doubling. The next step is to establish those actual color values established in the dried condition that correspond to the target color values allocated in the test form. This comparison is made on the basis of available standardized values in accordance with DIN or ISO or specific individualized requirements. On the basis of the selected actual dry-state color values, the corresponding desired wet-state color values are defined. A problem in this context is that when the target wet-state color values are defined, the actual wet-state color values are no longer available or are available only to a limited extent. In addition, this process needs to be carried out for any combination of paper, ink, blanket, and dampening solution that is used in the print shop. This represents a very time-consuming process that can only be implemented to a limited extent in practice.

Thus even in the past, some thought has been given to finding ways of shortening this complex process of the prior art. Such thoughts have been disclosed in published, non-prosecuted German patent application DE 10 2007 008 640 A1, which proposes a method for converting measured wet-state color values into dry-state color values. The method allows wet-state color values to be calculated from measured dry-state color values and vice versa, reducing the long period between printing the wet printed sheets and taking the color measurements on the dried printing substrate. In accordance with the method disclosed in the aforementioned publication, the measured wet-state color values are stored in a vector color space in a computer and a suitable correction vector is added to the measured wet-state color values to find the corresponding dry-state color values.

SUMMARY OF THE INVENTION

An object of the present invention is to provide a certification method for printing standards that is less complex than the known certification methods of the prior art.

In accordance with the invention, the object is attained by the main claim. Advantageous further embodiments of the invention will become apparent from the dependent claims, the description, and the drawing.

The method of the invention is distinguished by a succession of steps that also involve the use of a test form. The test form is provided with suitable measuring elements in the form of a print control strip to be able to evaluate problems such as dot gain, gray balance, slurring, doubling etc., which commonly occur especially in lithographic offset printing. A color measurement strip that, like the further measuring elements, may be present on the printing substrate multiple times, for example even in every ink zone, is used as a color control element. In addition, an intentional color deviation from the intended target color is defined for at least one ink zone in the inking unit of the printing unit. The colors and color deviations that have been set in this way are then corrected via the ink control device of the printing press. This is done in the wet condition, i.e. a period of waiting until the printing substrate has dried is not necessary. For this purpose, a color measuring device is used to evaluate the printing substrates in the wet condition. The color measuring device required for this purpose may be arranged in the press or outside the press. The new method of the invention is necessary in particular when a color measuring device that is arranged in the press is used because in the press, such a color measuring device, also known as an in-line color measuring device, can only measure the printing substrates in the wet condition as the drying process in the printing press takes a long time. Thus the color control loop is completed. Therefore, unlike in the prior art, the color control loop is established before the drying process of the printed sheets has been completed, when the sheets are still wet. This considerably shortens the color control process. In a next step, the printed substrates, which have dried in the meantime, are measured again by the same color measuring device and a comparison is made between the color values measured in the dry condition and the original of the test form in a computer. As a result of this comparison, the ink settings that belong to the ink zone with the minimum deviation from the desired target color are taken as the target ink setting for the printing process. The evaluation is done in the computer in an automated way using a predetermined selectable certification standard or a standard specifically created for the customer. In the evaluation, process parameters such as dot gain, gray balance, slurring and doubling etc. are used.

In accordance with an advantageous embodiment of the invention, the predetermined color deviations are calculated and set by the computer. In this case, the intentional color deviations for determining the measured color values at different inking levels are invariably defined by the computer, which may be a separate computer or a computer that is integrated into the press or part of the color measuring device. For this purpose, the computer may modify the target color values in steps to ensure that the intentional color deviations for determining the measured color values at different inking levels are set correctly and reproducibly at all times.

In accordance with a further embodiment of the invention, the number of ink zones to which the defined color deviations are applied is selectable via the computer. In this case, the operator may select the number of ink zones and, if desired, their location or may let the computer select a pre-defined given standard of ink zones and locations of ink zones. In the same way, the number and locations of the ink zones without defined color deviations, also referred to as the initial ink zone, may be stored in the computer.

In accordance with a particularly advantageous embodiment of the invention, the predetermined color deviations in the ink zones progress in two-percent steps in a step-like manner. In this case, the inking will increase in two-percent steps on one side of the initial ink zone and decrease in two-percent steps on the other side. The initial ink zone is advantageously located in the center of the ink zones. When the number of ink zones is even, for example 32, the two center ink zones may be used as the initial ink zone; likewise, the steps of the pre-defined color deviations may extend over two ink zones, i.e. every two ink zones have the same settings.

In accordance with a particularly advantageous embodiment of the invention, the set actual color values of the ink zones are stored in a file in the computer after the wet printing substrate has been compensated for. In the process, the respective actual ink zone color value of the printing substrate that has been compensated in the wet condition may be recorded by pushing a button in the menu of the computer via a suitable operating element. The respective ink zones and actual ink zone color values are stored in such a way that they are clearly allocated, i.e. ink zone and ink type are stored in a color set. An identification of the color set may be assigned automatically or manually. Data such as the job title, date and time of the measurement may be stored automatically or manually.

The method of the invention thus ensures that the major part of the settings for the certification process is predefined by the computer and that the process may be carried out by the operator without difficulty. As a result of the intentional predefined gradual over-inking or under-inking across multiple ink zones, e.g. 32 ink zones in the 70 format, a sufficiently wide gradation is achieved to ensure that a suitable dry-state target value is available. What are known as printing standards are basically only defined for CMYK printing. An additional advantage of the present invention is the addition of spot colors for package printers that produce the same product with different inking levels/standards for different countries. Depending on the selected color measurement strip, this is currently possible for up to ten colors.

Other features which are considered as characteristic for the invention are set forth in the appended claims.

Although the invention is illustrated and described herein as embodied in a automated definition of color test values, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is an illustration of a sheet-fed rotary printing press with color measuring devices and a press computer according to the invention.

DETAILED DESCRIPTION OF THE INVENTION

Referring now to the single FIGURE of the drawing in detail, the FIGURE illustrates an implementation of a method of the invention in a sheet-fed rotary lithographic offset printing press 101. It is to be understood that the method may be used in other lithographic offset printing presses. The sheet-fed printing press 101 in the FIGURE has four printing units 12 of essentially identical construction. Each printing unit 12 includes an inking unit 16 that is supplied with ink via an ink fountain 11 and evenly distributes the ink across the rollers in the inking unit 16 before applying it to a plate cylinder 13 carrying the printing form. The plate cylinder 13 in turn transfers the ink to the blanket cylinder 14. The blanket cylinder 14 and an impression cylinder 15 form a printing nip of the printing unit 12. Sheet-shaped printing substrates 20 are passed through the printing nip in each printing unit 12 to receive the respective color separation. In the printing press 101 in the FIGURE, four color separations may in this way be applied on top of each other in a straight printing mode. Alternatively, two color separations may be applied in the perfecting mode using reversing drums 150 provided between the printing units 12 to turn the sheets 20 from the front side to the back so that they may be printed on both sides. The printing substrates 20 are removed from a feeder stack 131 in the feeder 130 and transferred to the first printing unit 12 by a sheet feeding device 120. Once the sheets 20 have been printed and exited the last printing unit 12, they are transferred to the delivery 140 and deposited on a delivery stack 141.

The printing press 101 is controlled by a press computer 160, which has a screen 170 for displaying the current condition of the machine. The press computer 160 is connected to a power supply 6 of the press 101 and controls all drives and actuators of the printing press 101. The press computer 160 is further connected to an in-line measurement device 24 provided downstream of the last printing unit 12 and to an external color measuring device 21. The external color measuring device 21 consists of a sheet deposit 23 for receiving a printed sheet and a movable measuring bar scanning the printed sheet 20. To generate color measurements, the measuring devices 21, 24 either scan the entire surface of the produced sheets 20 or at least a color measurement strip 22 printed on the side. As the in-line measurement device 24 is arranged immediately downstream of the last printing unit 12, the sheets 20 are still wet when they are scanned by the in-line measurement device 24, which thus provides only current actual color values in the wet state, whereas the external color measuring device 21 may also measure dry printing substrates 20.

In accordance with the method of the invention, a test form is printed with different inking levels in the press 101. For this purpose, corresponding printing plates for the printing unit 12 are exposed by a plate exposure unit and mounted to the printing press 101. Once a number of printing substrates 20 have been produced using these printing forms and the corresponding ink settings in the respective printing unit 12, the wet printing substrates 20 are measured either in the press 101 using the in-line color measuring device 24 or outside the press 101 using the external color measuring device 21. The printing substrates 20 are produced in accordance with steps stored in the computer 160, i.e. under-inking and over-inking occurs in two-percent steps every two ink zones to the left or right of the central two ink zones. Thus two ink zones have the same inking level in the color measurement strip 22 on the printing substrate 20. The target color values defined in this way are then compensated by the control computer 160 with the aid of the wet-state actual color values measured by the color measuring devices 21, 24. As soon as the printing press 101 is in the corrected state, a sample sheet 20 is taken and the actual ink zone color values are stored by the control computer 160 in terms of the respective ink zone and color and, if desired, including additional data such as the job title, date, time of the measurement, color separation, number of the ink zone etc.

When the printed sheet 20 that has been corrected in the wet state has dried, a dry-state measurement is taken by the external color measuring device 21. If the in-line color measuring device 24 and the external color measuring device 21 have been calibrated relative to each other prior to the measurement, this may be done even if the printed sheet has been measured in the wet state by the in-line color measuring device 24. Like the measured actual wet-state color values, the actual color values measured in the dry state are likewise stored in a corresponding way, ink zone by ink zone. Subsequently, the press computer 160 carries out an automated comparison in which the measured dry-state color values and the measured wet-state color values are compared, factoring in process parameters such as dot gain, gray balance, slurring, doubling etc. Then the measured actual dry-state value is selected that has the smallest deviation from the target dry-state color value, i.e. from the measured color value of the original. Subsequently, that ink setting of the gradual over-inking or under-inking that corresponds to this established measured dry-state color value is selected as the correct setting by the control computer 160.

The following is a summary list of reference numerals and the corresponding structure used in the above description of the invention:

6 power supply
11 ink fountain
12 printing unit
13 plate cylinder
14 blanket cylinder
15 impression cylinder
16 inking unit
20 sheet
21 external color measuring device
22 color measurement strip
23 sheet deposit
24 in-line color measuring device
101 printing press
120 sheet feeding device
130 feeder
131 feeder stack
140 delivery
141 delivery stack
150 reversing drum
160 press computer
170 screen

The invention claimed is:

1. A method for adjusting ink settings in a printing press having a number of ink zones in an inking unit of a printing unit, which method comprises the steps of:

printing a test form onto a printing substrate with a preset color deviation from an intended target color in at least one ink zone in the inking unit of the printing unit and with at least one other ink zone in the inking unit of the printing unit without any preset color deviation from the intended target color;

correcting a previously set ink setting and the preset color deviation with respect to a respective target value in a wet condition of the printing substrate by means of a color measuring device;

taking color measurements of a dried printing substrate by means of the color measuring device;

comparing measured color values established in a dry state with an original of a test form in a computer; and selecting an ink setting of the ink zone that has a smallest deviation from the intended target color as a target ink setting for the printing process.

2. The method according to claim 1, which further comprises measuring the printing substrate by the color measuring device outside the printing press.

3. The method according to claim 1, which further comprises measuring the printing substrate by the color measuring device inside the printing press.

4. The method according to claim 1, which further comprises calculating and setting defined color deviations by the computer.

5. The method according to claim 4, which further comprises modifying target color values in the ink zones in steps in the computer to set the defined color deviations.

6. The method according to claim 4, wherein the number of ink zones to which the defined color deviations are applied is selectable by means of the computer.

7. The method according to claim 6, wherein an initial ink zone that is without defined color deviations is selectable by the computer.

8. The method according to claim 7, which further comprises invariably storing the number of the ink zones with the defined color deviations and the initial ink zone without defined color deviation in the computer.

9. The method according to claim 7, wherein the initial ink zone without the defined color deviations is in a center of the ink zones in the inking unit of the printing unit and wherein on one side of the initial ink zone, the defined color deviations are positive color deviations and on the other side of the initial ink zone the color deviations are negative color deviations.

10. The method according to claim 4, wherein the defined color deviations in the ink zones progress in two-percent steps.

11. The method according to claim 1, wherein once a wet printing substrate has been compensated for, storing a set of actual color values of the ink zones in a file in the computer.

* * * * *